US008608169B2

(12) United States Patent
Saunders et al.

(10) Patent No.: US 8,608,169 B2
(45) Date of Patent: Dec. 17, 2013

(54) PORTABLE TARGET APPARATUS

(76) Inventors: John Saunders, Larchmont, NY (US); Ian Root, Stowe, VT (US); Eldon Goates, Colorado Springs, CO (US)

( * ) Notice: Subject to any disclaimer, the term of this patent is extended or adjusted under 35 U.S.C. 154(b) by 373 days.

(21) Appl. No.: 12/931,823

(22) Filed: Feb. 11, 2011

(65) Prior Publication Data

US 2012/0205870 A1 Aug. 16, 2012

(51) Int. Cl.
*F41J 7/04* (2006.01)

(52) U.S. Cl.
USPC ..... 273/406; 273/392

(58) Field of Classification Search
USPC ..... 273/390–392, 403–410
See application file for complete search history.

(56) References Cited

U.S. PATENT DOCUMENTS

| | | | | | |
|---|---|---|---|---|---|
| 3,516,670 | A * | 6/1970 | Brieff et al. | ..... | 273/372 |
| 4,119,317 | A * | 10/1978 | Ohlund et al. | ..... | 273/406 |
| 4,288,080 | A * | 9/1981 | Laporte et al. | ..... | 273/406 |
| 4,540,182 | A * | 9/1985 | Clement | ..... | 273/392 |
| 5,240,258 | A * | 8/1993 | Bateman | ..... | 273/392 |
| 5,403,017 | A * | 4/1995 | Doss et al. | ..... | 273/372 |
| 5,409,238 | A * | 4/1995 | Norris | ..... | 273/392 |
| 5,934,678 | A * | 8/1999 | Theissen et al. | ..... | 273/386 |
| 7,694,973 | B1 * | 4/2010 | Hofmeister et al. | ..... | 273/406 |
| 7,900,927 | B1 * | 3/2011 | Bliehall | ..... | 273/359 |
| 7,950,667 | B2 * | 5/2011 | Shum | ..... | 273/406 |
| 8,047,546 | B1 * | 11/2011 | Klein | ..... | 273/406 |
| 2002/0158413 | A1 * | 10/2002 | Dehart | ..... | 273/390 |
| 2005/0098954 | A1 * | 5/2005 | Stutz | ..... | 273/390 |
| 2008/0174071 | A1 * | 7/2008 | Potterfield et al. | ..... | 273/392 |
| 2008/0265511 | A1 * | 10/2008 | Shum | ..... | 273/392 |
| 2008/0272070 | A1 * | 11/2008 | Hung | ..... | 211/26 |
| 2010/0225062 | A1 * | 9/2010 | Shum | ..... | 273/359 |
| 2012/0043722 | A1 * | 2/2012 | Mironichev et al. | ..... | 273/406 |

* cited by examiner

*Primary Examiner* — Mark Graham

(57) ABSTRACT

A portable target apparatus for use in target practice is provided. The target may be comprised of metal, for example steel. The target includes a base frame and a target plate that is attached to the base frame. Upon being struck by a projectile, the target plate rotates about the base frame into a knocked down position. One or more sensors sense the target is displaced into the knocked down position and a reset mechanism drives the target plate back to the initial position. The base frame of the target apparatus is of hollow construction, thereby making the target portable with relative ease.

17 Claims, 8 Drawing Sheets

PORTABLE TARGET APPARATUS

CROSS-REFERENCE TO RELATED APPLICATIONS

Not Applicable.

FIELD

This invention relates to a portable target apparatus, and more particularly, to a portable target apparatus that collapses when struck by a projectile and may be reset.

DISCUSSION OF RELATED ART

Target assemblies are designed and used for the purpose of allowing target practice. Because bullets are often shot from large distances at high speeds, targets need to be durable. Often, to make a target durable a manufacturer uses large amounts of durable materials such as metal. However, in making the target durable, a manufacturer also creates a number of disadvantages for the target.

These disadvantages include being larger, heavier, less portable, relatively slow reacting, relatively complex, incapable of independent operation, inefficient, incapable of "chain-reaction" operation (where one target triggers a subsequent target), insufficiently armored to provide long-term service with minimal maintenance, or ineffective at containing bullet splatter in a consistent, predictable manner.

In addition, shooters are often positioned a great deal away from a target during target practice making it difficult for a shooter to manually reset a target after the target has been struck by a projectile. Therefore, a user who wants to practice shooting multiple times, must have a target or targets that are capable of being struck a plurality of times, or a target that is capable of being reset.

SUMMARY

Provided is a portable target apparatus, comprising a base frame of hollow construction, comprising a front surface having a forward angle, a rear surface, a bottom including a plurality of feet, a top surface, an interior, and a base frame attachment mechanism, a target plate comprising a target plate attachment mechanism that is configured to attach to the base frame attachment mechanism, wherein when the target plate is struck by a projectile the target plate pivots about the base frame and rotates from an initial position to a knocked down position, an automatic reset mechanism disposed in the interior of the base frame and configured to drive the target plate back to the initial position when the target plate is displaced into the knocked down position, a power source disposed in the interior of the base frame and configured to power the automatic reset mechanism, one or more sensors that are configured to sense when the target plate is displaced into the knocked-down position, a printed circuit board (PCB) disposed in the interior of the base frame and electrically connected to the one or more sensors, the automatic reset mechanism, and the power source, wherein in response to the one or more sensors sensing that the target plate is displaced into the knocked-down position, the PCB activates the power supply to supply power to the automatic reset mechanism, and a lid above the opening of the base frame to conceal the interior of the base frame.

The base frame may be of rectangular shape.

The target plate and the base frame may be of steel construction.

The interior may comprise a padding for preventing the power source and the PCB from resting on a bottom surface of the interior, and for reducing shock to the power source and the PCB when the target plate is struck by a projectile.

The target plate may comprise one or more ears that are welded to the target plate and the base frame comprises a respective slot for receiving each of the one or more ears, wherein the one or more ears extend into the respective slots and into the interior of the base frame.

The target plate attachment mechanism may comprise an opening in each of the one or more ears, and the base frame attachment mechanism may comprise a bushing welded to the interior of the base frame such that each bushing is configured to receive an opening of a respective one of the one or more ears.

The target plate mechanism may comprise a first ear and a second ear each having an opening, and the base frame attachment mechanism comprise a first bushing and a second bushing each welded to the interior of the base frame, wherein the first bushing is configured to receive the opening of the first ear and the second bushing is configured to receive the opening of the second ear.

The second ear may be shorter in length than the first ear and the automatic reset mechanism may be disposed in the interior, below the second ear, and adjacent an arm of the first ear.

The automatic reset mechanism may include an attachment mechanism that attaches to the second ear, such that when power is supplied to the automatic reset mechanism, the automatic reset mechanism drives the second ear to return the target plate back to the initial position.

The bushing may be constructed of steel, and each bushing may include a piece of rubber configured to prevent the ear from touching the steel of a respective bushing.

The PCB may be electrically connected to a first sensor for sensing that the target plate has collapsed and a second sensor for sensing when the target plate has been returned to the initial position.

When the second sensor senses that the target plate has been returned to its original position, the PCB may shut off power to the automatic reset mechanism.

The lid may be fixedly secured to the base frame by a lid attachment mechanism.

The base frame may further comprise a handle that is configured to be grasped by a user.

The lid may comprise a rubber stop such that when the target plate is displaced by a projectile, the target plate comes to rest against the rubber stop and in the knocked down position.

When the target plate is in the initial position the target plate may be angled approximately ten degrees forward with respect to perpendicular to a top surface of the lid.

When the target plate is in the knocked down position the target plate may be approximately parallel with respect to a top surface of the lid.

The target plate may be constructed of reactive polymer.

The one or more sensors may be at least one of an inductive proximity sensor and a Hall effect sensor.

Figure 1:
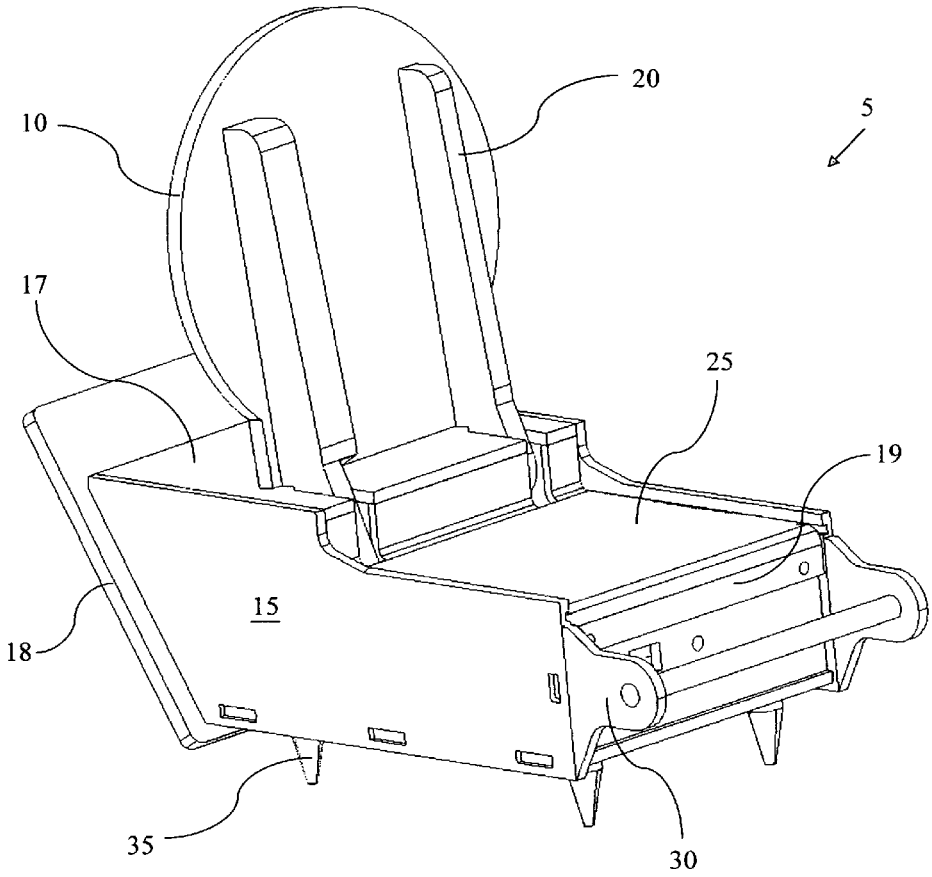
FIG. 1 is a diagram illustrating an example of a portable target apparatus, according to various embodiments.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. Any use of the word "means" herein is intended to invoke means-plus-function limitation in accordance with 35 U.S.C. §112, sixth paragraph, even if the word "means" follows words describing the function.

FIG. 1 illustrates an example of a portable target apparatus.

Referring to FIG. 1, portable target apparatus 5 includes a target plate 10 that is attached to a base frame 15. The target plate 10 may be secured to the base frame 15 such that when the target plate 10 is struck by a projectile 12 (shown in FIG. 2), the target plate 10 may pivot about the base frame 15, and rotate between an initial position and a knocked down position. The initial position and the knocked down position are further described with reference to FIGS. 2 and 3.

Figure 2:
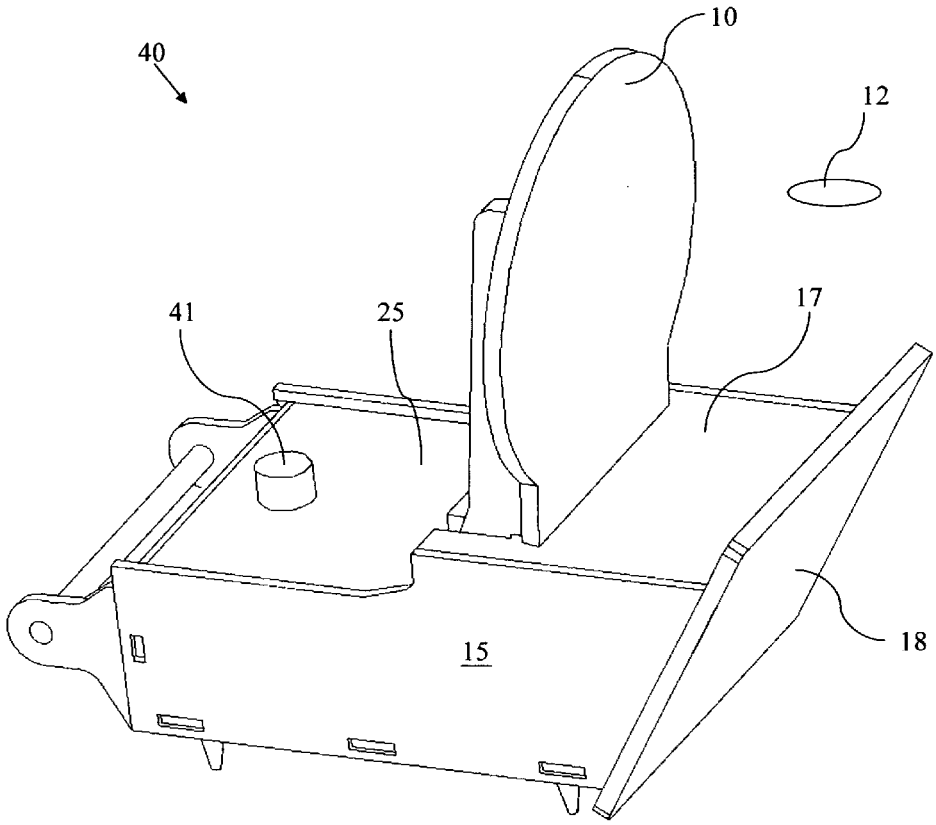
FIG. 2 is a diagram illustrating an example of the portable target apparatus with the target plate in an initial position, according to various embodiments.

Referring to FIGS. 1 and 2, the base frame 15 is of hollow construction and includes a front surface 18 that may have a forward angle. The forward angle provides a level of protection, for example, if the projectile 12 were to strike the front surface 18, instead of the target plate 10, the angle of the front surface 18 may allow the front surface 18 to direct the projectile 12 down into the ground. The hollow construction of the base frame 15 provides the portable target apparatus 5 with an interior (shown in FIG. 5). To conceal the interior and any parts located therein from the elements, a lid 25 be attached to the base frame 15. For example, the lid 25 may slide into grooves milled into the base frame 15, located above the interior. As another example, the lid 25 may rest on a tab or tabs that are set in the base frame 15.

The base frame includes a top surface 17, a rear surface 19, and a bottom including a plurality of feet 35, as shown in FIG. 1. The top surface may be approximately parallel to the lid 25. In this example shown in FIG. 1, the plane of the top surface 17 is located on a plane slightly above the plane of the lid 25, but relatively parallel. This illustration is merely for purposes of example, and it should be appreciated that the lid 25 may be located on the same plane as the top surface 17, or on a different plane as the top surface 17. The feet 35 may be arranged such that the bottom of the base frame 15 does not touch a ground surface, when the portable target apparatus 5 is placed on a surface. In some embodiments, the feet may be of a shape that may be received in a stand. For example, the feet may have a conical shape, or other desired shape, that is configured to be received by a stand (not shown). The stand may be used to adjust the height of the portable target apparatus 5.

According to various embodiments, the lid 25 may be fixedly secured above the interior of the base frame 15 by securing the lid 25 to the base frame 15. For example, the lid 25 may include one or more openings that align with threaded grooves located in the base frame 15. The lid 25 may be securely fastened to the base frame 15 by bolting the lid 25 to the base frame using one or more screws or bolts that are configured to be received by the one or more openings in the lid 25 and the threaded grooves of the base frame 15.

The target plate 10 may include one or more ears 20 that may be welded to the target plate. In some embodiments, the target plate 10 and the one or more ears 20 may be constructed of one piece. The base frame 15 may include a slot for each respective ear 20 of the target plate 10. Accordingly, each ear 20 may be inserted into a respective slot of the base frame 15, and into the interior of the base frame 15. In FIGS. 1-6 the ears 20 are welded or otherwise attached to the target plate 10. However, the portable target apparatus is not limited to this construction. Other examples of the target plate are given herein with reference to FIGS. 7 and 8.

Figure 3:
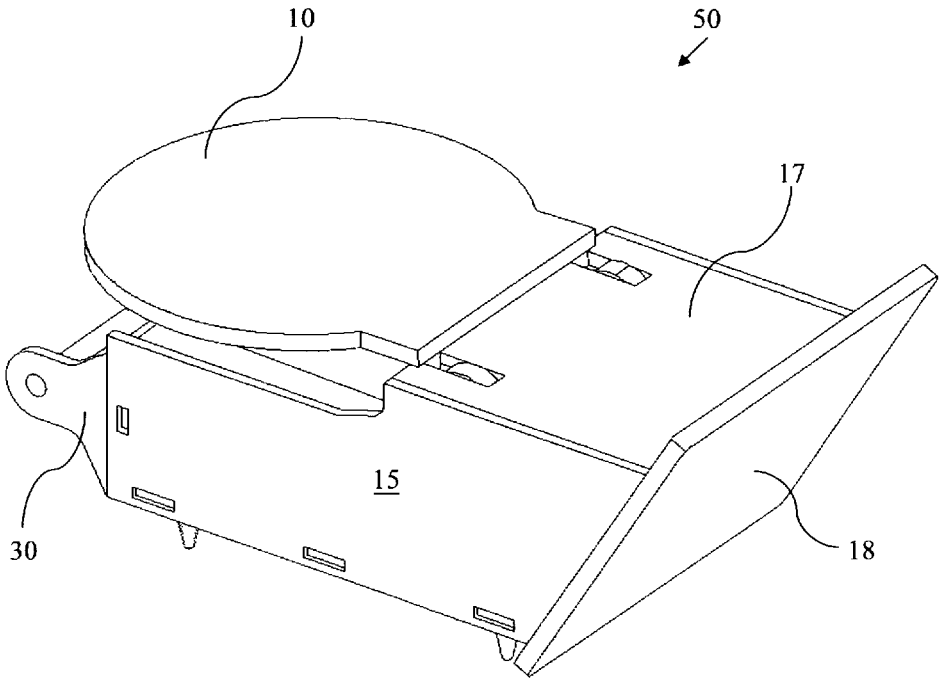
FIG. 3 is a diagram illustrating an example of the portable target apparatus with the target plate in a knocked-down position, according to various embodiments.

The target plate 10 may rest in an initial position 40 as shown in FIG. 2. When the target plate is struck by the projectile 12, the target plate is configured to pivot about the base frame 15 and rotate into a knocked down position 50, as shown in FIG. 3.

Referring again to FIG. 1, the base frame may include a handle 30 attached thereto. The handle may be grasped by a user. While each of the target plate 10, the base frame 15, the ears 20, the lid 25, and the handle 30 may be constructed of metal, for example steel, the hollow construction of the base frame 15 provides a relatively light weight construction for the portable target apparatus 5. Accordingly, a user may freely grasp the handle 30 and carry the portable target apparatus 5 to a desired location.

FIG. 2 illustrates an example of the portable target apparatus with the target plate in an initial position.

Referring to FIG. 2, in the initial position 40, the target plate 10 may be approximately perpendicular with a top surface 17 of the base frame 15. In some embodiments, similar to the front plate 18, the target plate 10 may be disposed at a forward angle with respect to perpendicular. For example, in the initial position 40, the target plate 10 may be disposed at a forward angle of approximately 5°, 10°, 15°, 20°, 25°, 30°, or other desired angle. Also shown in FIG. 2, the lid 25 may further include a stop 41 configured to receive the target plate 10. For example, the stop 41 may include a rubber stop, a metal stop, a plastic stop, a combination thereof, or other desired material. Accordingly, when the target plate 10 is struck by a projectile, the target plate 10 may fall down to a knocked down position such that the target plate 10 comes to rest in contact against the stop 41.

FIG. 3 illustrates an example of the portable target apparatus with the target plate in a knocked down position.

Referring to FIG. 3, when struck by a projectile the target plate may fall or otherwise be displaced to a knocked down position 50. When in the knocked down position, for example, the target plate may come to rest at a point such that the target plate 10 is approximately parallel with the top surface 17 of the base frame 15. As another example, the target plate 10 may come to rest in a knocked down position such that the target plate 10 is not parallel with the top surface 17 of the base frame 15, but is rather angled with respect to the top surface 17. For example, the target plate 10 may come to rest at an angle such that the target plate 10 is angled upward with respect to parallel, or angled downward with respect to parallel.

Figure 4A:
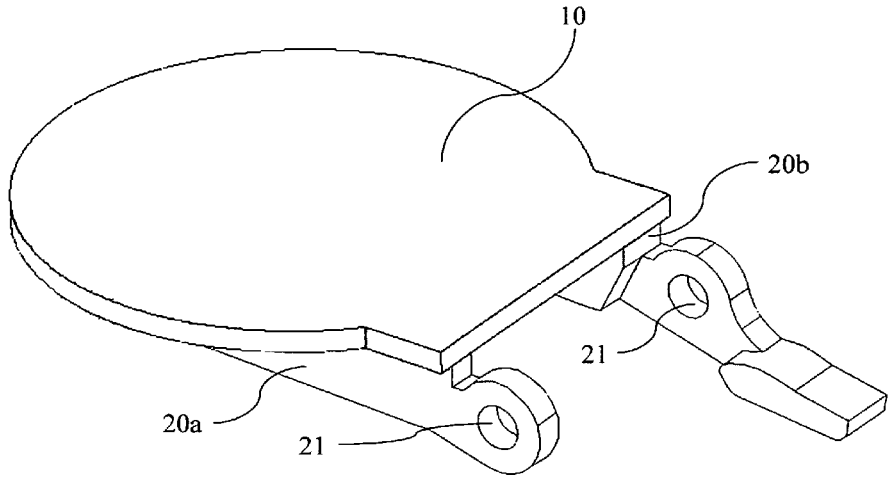
FIG. 4A is a diagram illustrating an example of a target plate removed from the base frame of the portable target apparatus, according to various embodiments.

FIG. 4A illustrates an example of a target plate removed from the base frame of the portable target apparatus.

Referring to FIG. 4A, the target plate 10 includes a plurality of ears 20*a* and 20*b*. In this example, the target plate 10 includes two ears. The use of two ears is merely for purposes of example, and it should be understood that the target plate 10 may include one ear, two ears, three ears, or more. The ears may be of any desired shape and size. In this example, the ears 20*a* and 20*b* are almost as long as the target plate 10, however, the ears 20*a* and 20*b* are not limited to this construction. The target plate 10 may include one or more target plate attachment mechanisms 21. In this example, the target plate attachment mechanism is a hole located in each of the ears 20. Each target plate attachment mechanism 21 may be configured to be received by a respective base plate attachment mechanism (not shown), for example, a bushing disposed in the interior of the base frame. Accordingly, the target plate 10 may be configured to pivot about the base frame such that the base plate attachment mechanism serves as the point of rotation for the target plate 10. The target plate 10 may be secured to the base frame by attaching the target plate attachment mechanism 21 to the base plate attachment mechanism.

As shown in the example of FIG. 4A, ear 20*a* is shorter in length than ear 20*b*. Accordingly, when mounted into the base frame, one or more components may be disposed in the interior of the base frame, below the ear 20*a*, and adjacent the ear 20*b*.

Figure 4B:
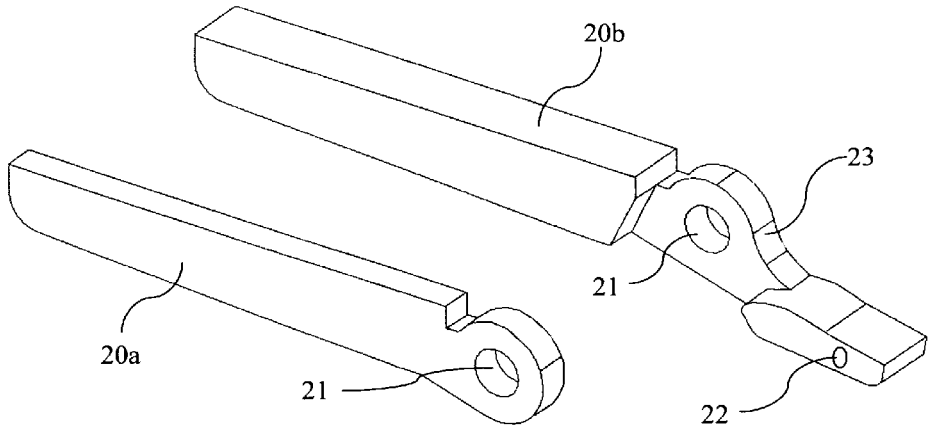
FIG. 4B is a diagram illustrating an example of an arm of an ear of the target plate, according to various embodiments.

FIG. 4B illustrates an example of an arm of an ear of the target plate.

Referring to FIG. 4B, the ear 20 includes a target plate attachment mechanism 21, an arm 23, and a reset attachment mechanism 22. The reset attachment mechanism 22 may be configured to attach to a component of an automatic reset mechanism. For example, the reset attachment mechanism may be a groove or slot configured to receive an arm of the automatic reset mechanism. Accordingly, the automatic reset mechanism may be configured to drive the ear to drive the target plate 10 from the knocked down position 50 to the initial position 40. The automatic reset mechanism is further described with reference to FIG. 5.

Figure 5:
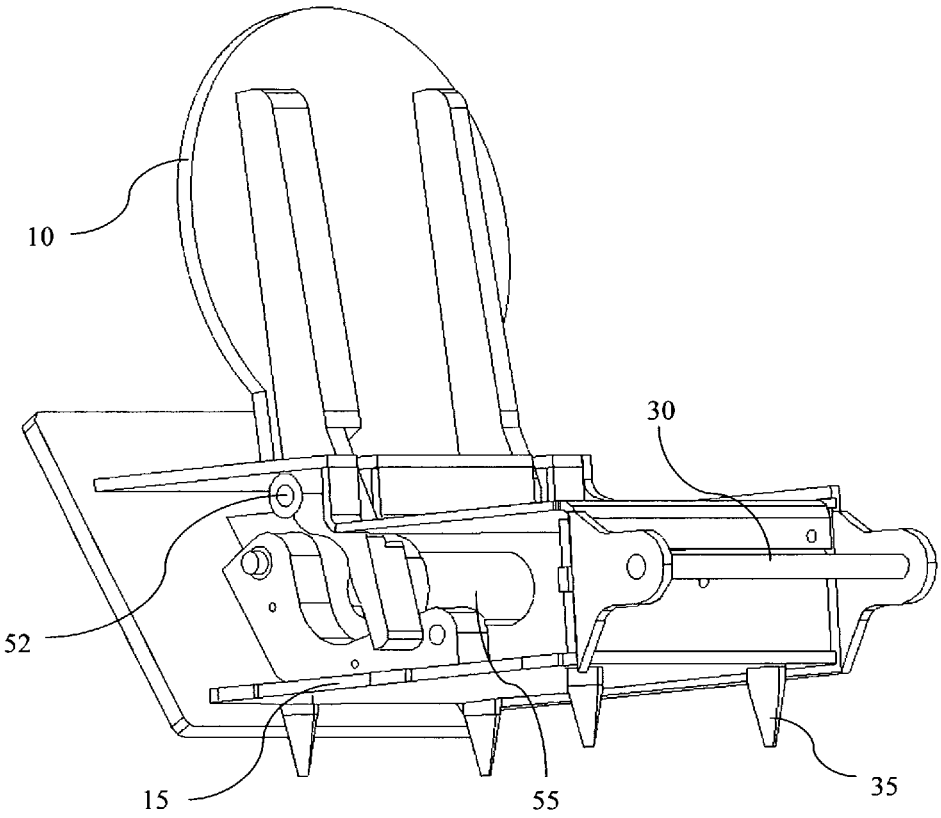
FIG. 5 is a diagram illustrating an example of an interior of the base frame of the portable target apparatus, according to various embodiments.

FIG. 5 illustrates an example of an interior of the base frame of the portable target apparatus.

Referring to FIG. 5, disposed in the interior of the base frame is an automatic reset mechanism 55, a power supply 56 (not shown), and a printed circuit board (PCB) 57 (not shown). The automatic reset mechanism may include an attachment mechanism that allows the automatic reset mechanism to attach to the target plate 10. The automatic reset mechanism may be a motor, for example, a DC brush gear motor, and the like.

The power supply 56 may include one or more batteries. For example, a 4.5 volt battery, a 9 volt battery, a 12 volt battery, a combination thereof, or other desired battery supply. The power supply 56 may provide power to the automatic reset mechanism 55 to drive the mechanism to reset the target plate from the knocked down position 50 (shown in FIG. 3), back to the initial position 40 (shown in FIG. 2).

The PCB 57 may electrically connect the automatic reset mechanism 55 and the power supply 56. Accordingly, the PCB 57 may include circuitry and software that is configured to signal the power supply 56 to supply power to the automatic reset mechanism 55.

The PCB 57 may also be electrically connected to one or more sensors. For example, the sensors may include a proximity sensor, an optical sensor, and the like. Accordingly, the PCB 57 may electrically connect the automatic reset mechanism 55, the power supply 56, and one or more sensors. An example of a proximity sensor is an inductive proximity sensor. An example of the optical sensor is an Omicron EE-SX1041 sensor. One or more sensors may be used to sense the position of the target plate 10. For example, a single sensor may be positioned in the interior of the base frame and may be capable of sensing that the target plate 10 is displaced into the knocked down position. Accordingly, upon the sensor sensing that the target plate 10 is in the knocked down position, the PCB 57 may trigger the power supply 56 to supply power to the automatic reset mechanism 55. The automatic reset mechanism 55 may drive the target plate 10 from the knocked down position back to the initial position.

The same sensor may also be used to sense that the target plate 10 has been moved back to the initial position. Upon the sensor sensing the return of the target plate 10 to the initial position, the PCB 57 may trigger the power supply 56 to shut off power to the automatic reset mechanism 55.

In some embodiments, a plurality of sensors may be used. For example, a first sensor may be used to sense that the target plate 10 is displaced into the knocked down position and a second sensor may be used to sense that the target plate 10 has been returned to the initial position.

As shown in FIG. 5, the base frame attachment mechanism may include a bushing 52. The bushing 52 may be received by the target plate attachment mechanism of the target plate 10. To prevent the target plate from rubbing against the bushing, each bushing may include a piece of rubber configured to prevent the outside wall of the opening of the ear from touching the respective bushing.

Figure 6:
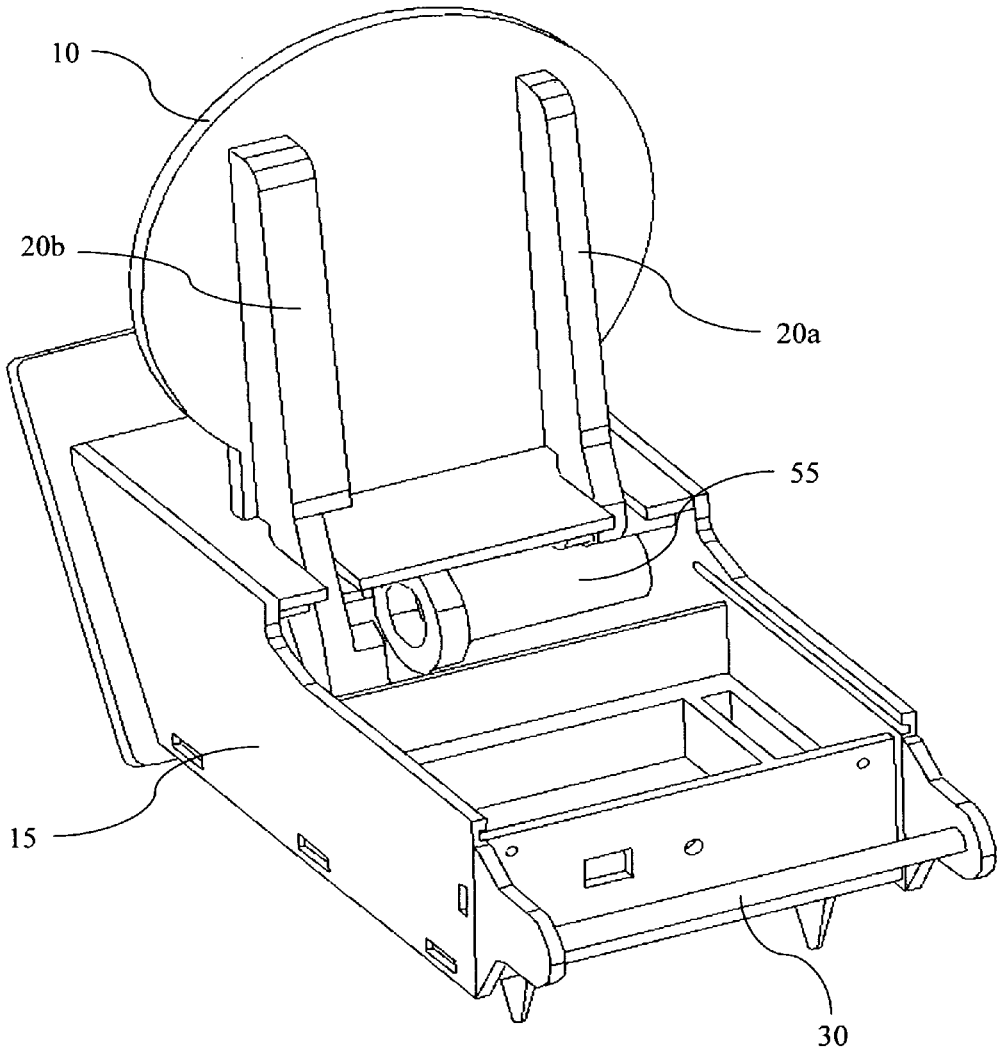
FIG. 6 is a diagram illustrating a rear view of the portable target apparatus with the lid removed, according to various embodiments.

FIG. 6 illustrates a rear view of the portable target apparatus with the lid removed.

Referring to FIG. 6, with the lid removed, the interior of the base frame 15 may be accessed by a user. In this example, the target plate 10 includes two ears 20*a* and 20*b*. Ear 20*a* is shorter in length that ear 20*b*. As shown in FIG. 6, the automatic reset mechanism may be disposed in the interior of the base frame 15 such that automatic reset mechanism 55 is disposed beneath the ear 20*a* and adjacent the ear 20*b*. With the automatic reset mechanism 55 disposed adjacent ear 20*b*, the automatic reset mechanism may attach to the ear 20*b*.

Accordingly, when the automatic reset mechanism 55 is supplied with power, the automatic reset mechanism 55 may drive ear 20*b*, thereby driving target plate 10 back to the initial position.

Also not shown, the interior of the base frame may include padding 58 that is capable of padding the power supply 56 and the PCB 57 such that the power supply 56 and the PCB 57 are protected from the bottom of the base frame. This prevents ground water from seeping into the power supply 56 and the PCB 57. In addition, the padding 58 may provide shock resistance to the power supply 56 and the PCB 57 when the target plate 10 is struck by a projectile.

Figure 7:
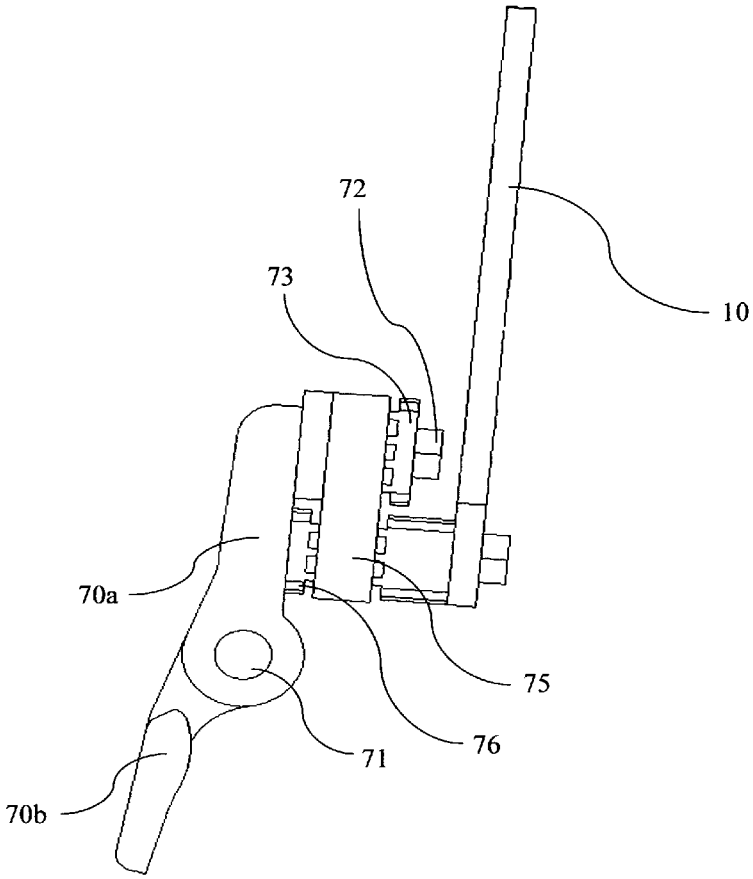
FIG. 7 is a diagram illustrating an example of a target plate attached to arms with padding located between the target plate and the arms.

FIG. 7 illustrates an example of a target plate attached to ears with padding located between the target plate and the arms.

Referring to FIG. 7, the target plate 10 is fastened to a padding 75. For example, the padding may include rubber, plastic, foam, synthetic material, and the like, and the padding may provide a shock absorbing feature to the target plate 10 such that when the target plate 10 is struck by a projectile, some of the shock of the projectile striking the target plate 10 may be absorbed by the padding 75.

In the example of FIG. 7, the ears 70*a* and 70*b* are not attached directly to the target plate 10, but instead attach to the padding 75. For example, the ears may include an attachment means 72 such as a threaded element. The ears also include openings 71 that function as a base frame attachment mechanism. The padding may include holes that allow the threaded elements 72 to travel through the padding 75. The padding 75 may be attached to the ears by securing a bolt 73 to the threaded element 72 and tightening the bolt 73 until the padding 75 is securely fastened to the ears 70*a* and 70*b*. For example, each ear (70*a* and 70*b*) may include its own respective threaded element 72, and a plurality of bolts 73 may be used to secure the padding 75 to the ears.

Also in this example, the target plate 10 is attached to the padding 75 as well. For example, like the ears, the target plate may include one or more threaded elements and the padding may include holes that allow threaded element of the target plate 10 to travel through the padding 75. The target plate 10 may be secured to the padding 75 by tightening bolt 76, or a plurality of bolts 76, one for each respective threaded element of the target plate 10.

Accordingly, as shown in FIG. 7, when a projectile strikes the target plate 10, some of the initial shock may be absorbed by the padding 75.

Figure 8:
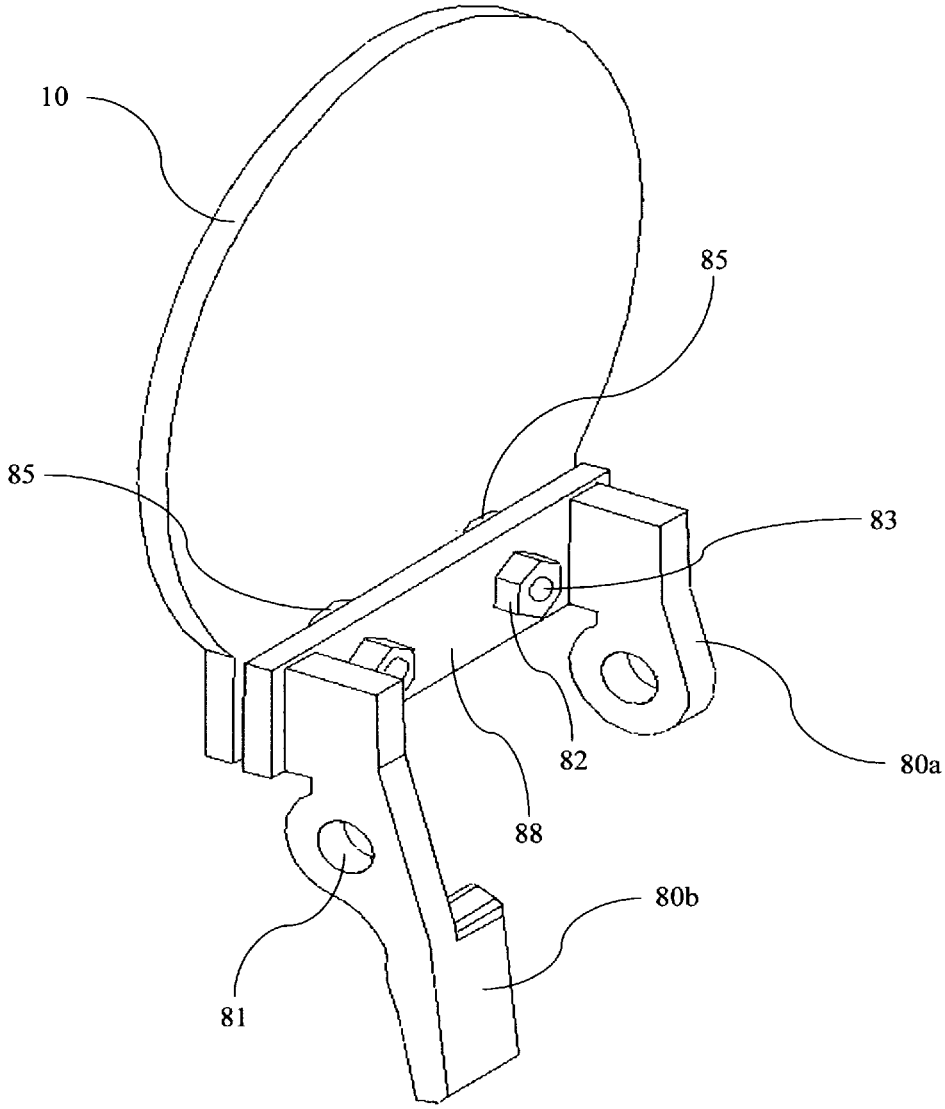
FIG. 8 is a diagram illustrating another example of a target plate attached to arms with padding located between the target plate and the arms.

FIG. 8 illustrates another example of a target plate attached to arms with padding located between the target plate and the arms.

Referring to FIG. 8, ears 80*b* and 80*a* are attached to each other via ear plate 88. For example, the ears 80*a* and 80*b* may be welded to the ear plate 88. As another example, the ears 80*a* and 80*b* and the ear plate 88 may be of one constructed piece. For example, one constructed piece of steel. The ears 80*a* and 80*b* also include openings 81 that function as base frame attachment mechanisms.

For example, the target plate 10 may include one or more attachment mechanisms 83 that may be welded to the target plate 10, or that are of unified construction with the target plate 10. As another example, the one or more attachment mechanisms 83 may be bolted to the target plate 10. In this example, the target plate 10 includes two attachment mechanisms 83. The ear plate 88 may include openings for receiving the attachment mechanisms 83. A bolt 82 or other fastener may be used to secure the ear plate 88 to the target plate 10 by tightening the bolt 82 around the attachment mechanisms 83 of the target plate 10. In this example, the target plate 10 includes two attachment mechanisms, but it should be appreciated that more or less attachment mechanisms may be used.

Also shown in FIG. 8 is padding 85. For example, before tightening bolt 82 around attachment mechanism 83, padding 85 may be inserted between the ear plate 88 and the target plate 10 to provide shock absorbance. For example, the padding 85 may include rubber, plastic, foam, synthetic material, and the like, which provides shock absorbance when a projectile strikes the target plate. In the example of FIG. 8, the padding 85 is relatively smaller than the padding illustrated in FIG. 7. This may allow the target to be lighter in weight. For example, the padding 85 may be 0.1 inches, 0.2 inches, 0.3 inches, 0.4 inches, 0.5 inches, and the like, in width.

Also shown in FIGS. 7-88, ears (70*a* and 70*b*) and (80*a* and 80*b*) are shorter than the ears shown in FIGS. 1-6. It should be appreciated that the ears are not limited to his size either and may be of any desired width, length, and shape.

While a particular form of the invention has been illustrated and described, it should be apparent that various modifications can be made without departing from the spirit and scope of the invention. For example, in examples shown in the figures, the base frame of the portable target apparatus is generally rectangular in shape with the sides of the base frame being longer in length than the front surface and a rear surface. The rectangular shape is merely for purposes of example and it should be understood that the size and shape of the base frame may be any desired shape, for example, circular, diamond, square, octagonal, or other desired shape. As another example, instead of automatically resetting itself, the target apparatus could also be paired with a remote control that allows a user to remotely trigger the target back into place. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain examples of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A portable target apparatus, comprising:

a base frame of hollow construction, comprising a front surface having a forward angle, a rear surface, a bottom including a plurality of feet, a top surface, an interior, and a base frame attachment mechanism;

a target plate comprising a target plate attachment mechanism that is configured to attach to the base frame attachment mechanism, wherein when the target plate is struck by a projectile the target plate pivots about the base frame and rotates from an initial position to a knocked down position;

an automatic reset mechanism disposed in the interior of the base frame and configured to drive the target plate back to the initial position when the target plate is displaced into the knocked down position;

a power source disposed in the interior of the base frame and configured to power the automatic reset mechanism;

one or more sensors that are configured to sense when the target plate is displaced into the knocked-down position;

a printed circuit board (PCB) disposed in the interior of the base frame and electrically connected to the one or more sensors, the automatic reset mechanism, and the power source, wherein in response to the one or more sensors sensing that the target plate is displaced into the knocked-down position, the PCB activates the power supply to supply power to the automatic reset mechanism; and a lid that is configured to slide into grooves above the opening of the base frame to conceal the interior of the base frame, wherein the target plate comprises one or more ears that are welded to the target plate and the base frame comprises a respective slot for receiving each of the one or more ears, the one or more ears extend into the respective slots and into the interior of the base frame, the target plate attachment mechanism comprises an opening in each of the one or more ears, and the base frame attachment mechanism comprises a bushing welded to the interior of the base frame such that each bushing is configured to receive an opening of a respective one of the one or more ears.

2. The portable target apparatus of claim 1, wherein the base frame is of rectangular shape.

3. The portable target apparatus of claim 1, wherein the target plate and the base frame are of steel construction.

4. The portable target apparatus of claim 1, wherein the interior comprises a padding for preventing the power source and the PCB from resting on a bottom surface of the interior, and for reducing shock to the power source and the PCB when the target plate is struck by a projectile.

5. The portable target apparatus of claim 1, wherein the target plate mechanism comprises a first ear and a second ear each having an opening, and the base frame attachment mechanism comprises a first bushing and a second bushing each welded to the interior of the base frame, wherein the first bushing is configured to receive the opening of the first ear and the second bushing is configured to receive the opening of the second ear.

6. The portable target apparatus of claim 5, wherein the second ear is shorter in length than the first ear and the automatic reset mechanism is disposed in the interior, below the second ear, and adjacent a distal end of the first ear.

7. The portable target apparatus of claim 6, wherein the automatic reset mechanism includes an attachment mechanism that attaches to the second ear, such that when power is supplied to the automatic reset mechanism, the automatic reset mechanism drives the second ear to return the target plate back to the initial position.

8. The portable target apparatus of claim 1, wherein the bushing is constructed of steel, and each bushing includes a piece of rubber configured to prevent the ear from touching the steel of a respective bushing.

9. The portable target apparatus of claim 1, wherein the PCB is electrically connected to a first sensor for sensing that the target plate has collapsed and a second sensor for sensing when the target plate has been returned to the initial position.

10. The portable target apparatus of claim 9, wherein when the second sensor senses that the target plate has been returned to its original position, the PCB shuts off power to the automatic reset mechanism.

11. The portable target apparatus of claim 1, wherein the lid is fixedly secured to the base frame by a lid attachment mechanism.

12. The portable target apparatus of claim 1, wherein the base frame further comprises a handle that is configured to be grasped by a user.

13. The portable target apparatus of claim 1, wherein the lid comprises a rubber stop such that when the target plate is displaced by a projectile, the target plate comes to rest against the rubber stop and in the knocked down position.

14. The portable target apparatus of claim 1, wherein when the target plate is in the initial position the target plate is angled approximately ten degrees forward with respect to perpendicular of a top surface of the lid.

15. The portable target apparatus of claim 1, wherein when the target plate is in the knocked down position the target plate is approximately parallel with respect to a top surface of the lid.

16. The portable target apparatus of claim 1, wherein the target plate is constructed of reactive polymer.

17. The portable target apparatus of claim 1, wherein one or more optical sensors include at least one of an inductive proximity sensor.

* * * * *